US006953904B1

(12) United States Patent
Meagher et al.

(10) Patent No.: US 6,953,904 B1
(45) Date of Patent: Oct. 11, 2005

(54) PEDAL ACTUATED SWITCH ASSEMBLY

(75) Inventors: James Meagher, Indianapolis, IN (US); Mitchell C. Owen, Jr., Greenwood, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/955,768

(22) Filed: Sep. 30, 2004

(51) Int. Cl.[7] ..... H01H 3/02; H01H 3/14
(52) U.S. Cl. ..... 200/61.89; 200/529
(58) Field of Search ..... 200/61.89, 523–529, 200/86.5

(56) References Cited

U.S. PATENT DOCUMENTS 4,227,060 A * 10/1980 Ayres et al. ..... 200/61.89 X
5,162,625 A * 11/1992 Comerford ..... 200/61.89
5,241,144 A * 8/1993 Meagher et al. ..... 200/61.89
5,321,219 A 6/1994 Meagher et al.
5,534,672 A * 7/1996 Meagher ..... 200/61.89
5,626,223 A * 5/1997 Lee ..... 200/529
5,641,060 A * 6/1997 Tracey ..... 200/526
5,670,761 A 9/1997 Ryan et al.
5,853,084 A 12/1998 Carter et al.
5,929,407 A * 7/1999 Ziem ..... 200/61.89
6,491,356 B2 12/2002 Kanazawa et al.
6,749,269 B1 6/2004 Niwa

* cited by examiner

*Primary Examiner*—James R. Scott
(74) *Attorney, Agent, or Firm*—Harness, Dickey & Pierce, PLC

(57) ABSTRACT

A pedal actuated switch assembly The switch assembly comprises a housing, a linear actuator resiliently supported in the housing and coupled with the a pedal for linear movement relative to the housing, a rotational actuator rotatably supported in the housing and coupled with the linear actuator such that the linear movement of the linear actuator produces a rotational movement of the rotational actuator, and an electrical switch supported in the housing and controllable by the rotational movement of the rotational actuator for selectively opening and closing the electrical switch.

20 Claims, 5 Drawing Sheets

PEDAL ACTUATED SWITCH ASSEMBLY

FIELD OF THE INVENTION

The present invention relates to a switch assembly that can be actuated by the depression of a pedal, such as the brake pedal of a vehicle.

BACKGROUND OF THE INVENTION

Pedal actuated switch assemblies are used in vehicles for operating or interacting with various brake-related systems on the vehicle, such as brake lights, brake assisting systems, engine brakes, and cruise control systems, among others.

It is desirable to provide pedal actuated switch assemblies that operate reliably, do not interfere with a smooth feel during braking, and can be easily mounted in different positions relative to the brake pedal for vehicles having different build.

SUMMARY OF THE INVENTION

The invention provides a switch assembly that can be actuated by depressing a pedal, such as the brake pedal of the brake system of a vehicle. The switch assembly comprises a linear actuator that is coupled to a rotational actuator and converts a linear movement to a rotational movement with a displacement advantage, thereby improving the feel of braking operation while using tight tolerances between a pedal pin and a push rod of a booster in the brake system. The rotational actuator operates by a camming action to provide normally open and normally closed electrical connections to respective electrical circuits on the vehicle. Each electrical connection is effected by an electrical switch that comprises a pair of single-pole single-throw (SPST) terminal arrangements connected in parallel. The parallel connection provides redundancy, and reduces electrical resistance and heat generation, thereby improving the reliability of the switch assembly. The switch assembly further provides rear egress to the terminal arrangement, such that the switch assembly can be universally used for different positioning arrangements relative to the pedal.

In one aspect, the switch assembly comprises a housing coupled to the brake pedal, a linear actuator resiliently supported within the housing for relative linear movement with respect to the housing, and a rotational actuator rotatably supported within the housing and coupled with the linear actuator such that a linear movement of the linear actuator causes a rotational movement of the rotational actuator. The switch assembly further comprises at least one electrical switch supported in the housing and operable to open or close in response to the rotational movement of the rotational actuator.

The switch assembly may comprise at least another electrical switch. At least one of the electrical switches is closed only when the pedal is in the rest position, and at least another of the electrical switch is closed only when the pedal is in the depressed position.

In one aspect of the invention, the rotational actuator is pivotable about a first axis relative to the housing and pivotable about a second axis relative to the linear actuator. The second axis is offset from the first axis such that the linear movement of the linear actuator causes a corresponding rotational movement of the rotational actuator for selectively closing and opening the electrical switch.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF PREFERRED EMBODIMENTS

The following description of preferred embodiments is merely exemplary in nature and is in no way intended to limit the invention, its application, or uses.

Referring to FIGS. 1, 2A, 2B and 3, an exemplary pedal actuated switch assembly 100 for use in a vehicle brake system is illustrated according to one aspect of the invention. The pedal actuated switch assembly 100 can be associated with various brake-related functions in a vehicle, such as operation of the brake lights, disengaging of the cruise control, engine brake control, etc. The switch assembly 100 comprises a housing 102 which can be molded from a dielectric material, such as, for example, a plastic or composite, including partially glass-filled nylon. The housing 102 can include a base 104, and a cover 106 that can be attached to the base 104 by mutually engageable attachment formations, such as projections and slots, other snap-fit type connections, or other known fastening devices, like threaded fasteners, for example. Exemplary mating attachment formations are indicated at 108 and 110.

Figure 4:
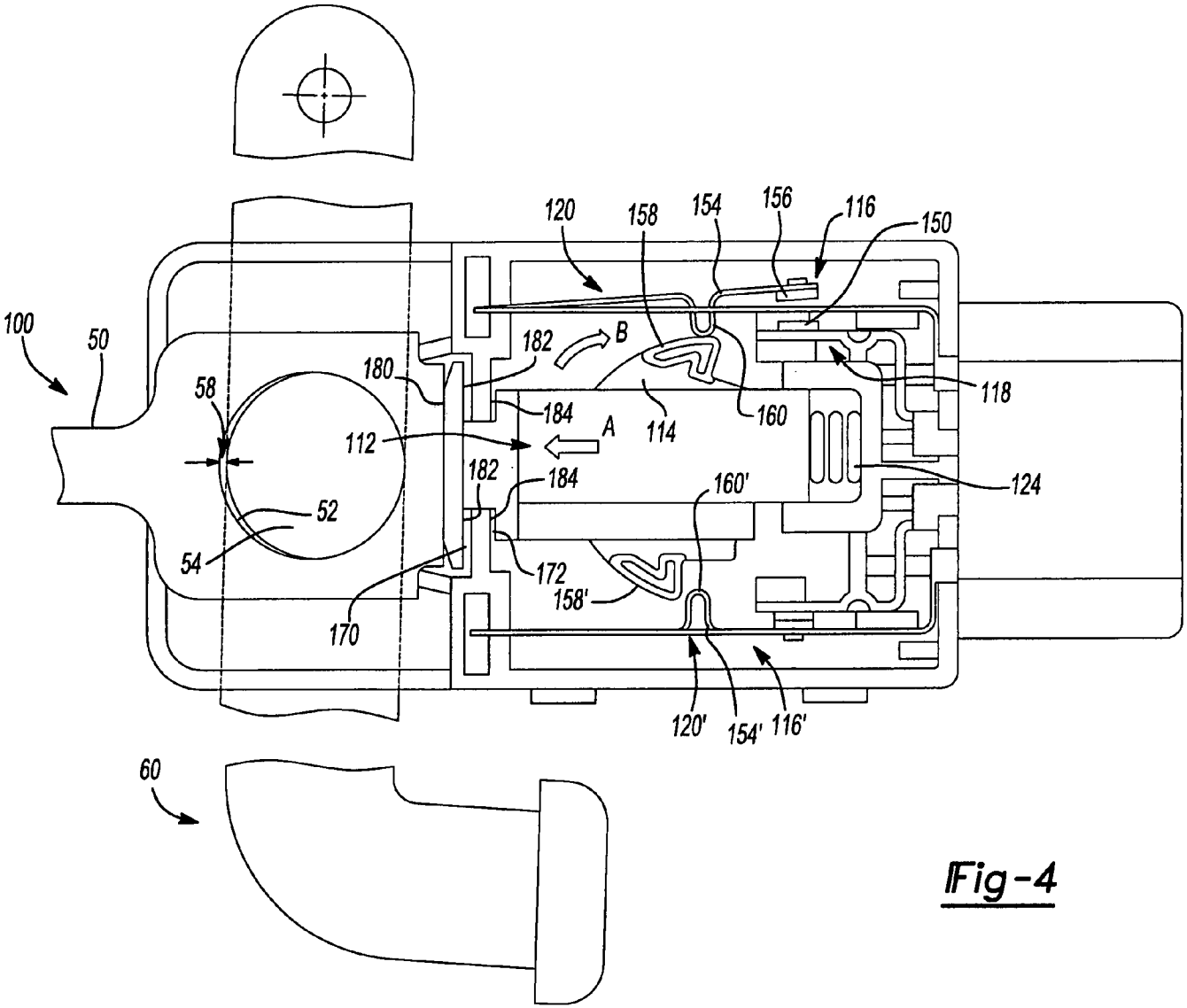
FIG. 4 is a plan view of the switch assembly of FIG. 1, shown uncovered, and connected to a brake pedal at rest.
Figure 5:
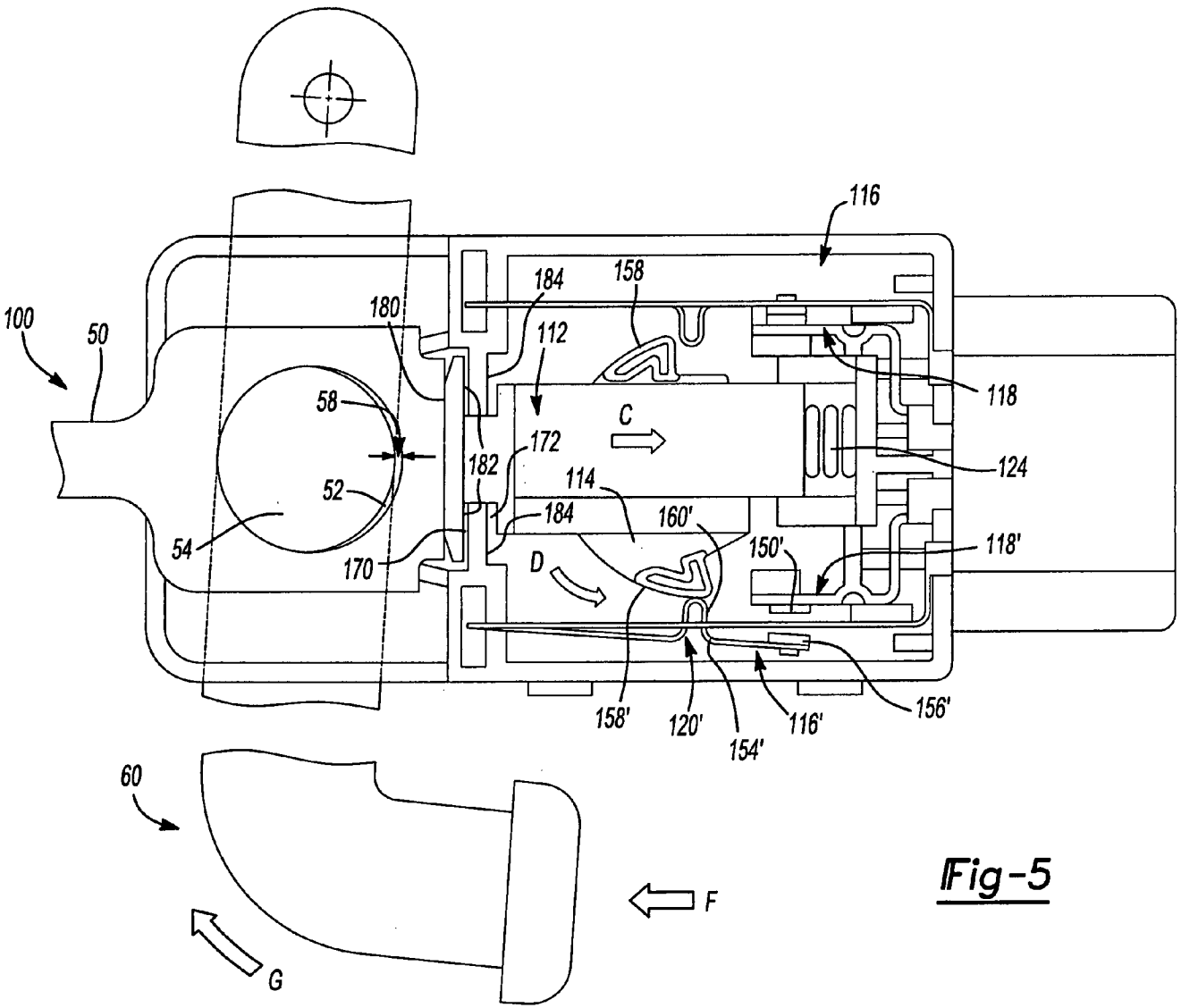
FIG. 5 is a plan view of the switch assembly of FIG. 1, shown uncovered, and with the brake pedal depressed.

Referring to FIGS. 1 to 4, the housing 102 is coupled to a push rod 50 of a brake booster by means of a pedal pin 54 of a brake pedal 60. The push rod 50 has an aperture 52 which is aligned with an opening 130 defined in the housing 102 (best seen in FIG. 1). In the exemplary housing 102 illustrated in FIGS. 1 and 2, the opening 130 is defined by a hole 132 in the base 104 and a cutout 134 in the cover 106. The pedal pin 54 of the brake pedal 60 passes through the opening 130 of the housing 102 and the aperture 52 of the push rod 50. When the brake pedal 60 is at an at-rest position (not depressed), as illustrated in FIG. 4, a crescent-shaped gap 58 is formed between the aperture 52 of the push rod 50 and the pedal pin 54 at a first side of the pedal pin 54, nearer the booster. When the brake pedal 60 is depressed, as illustrated in FIG. 5, the pedal pin 54 rotates causing the housing 102 to move, and relative movement between the housing 102 and the push rod 50 causes the crescent-shaped gap 58 to move to a second side of the pedal pin 54, further from the booster.

Figure 1:
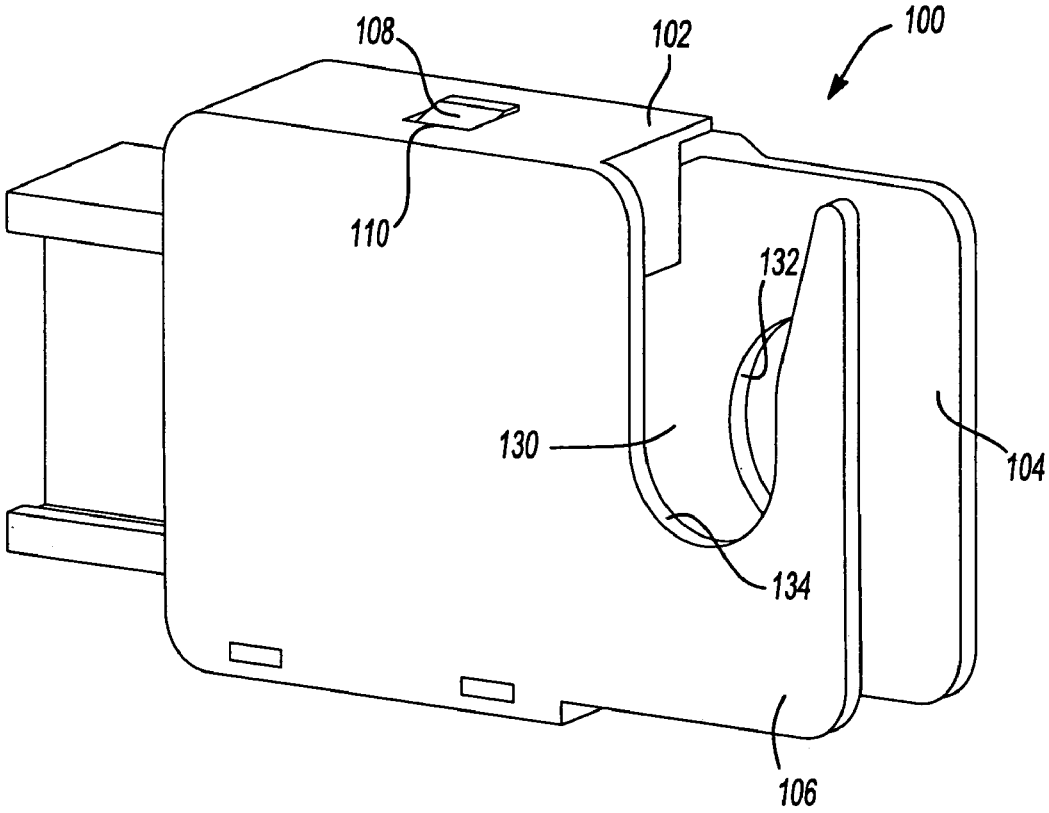
FIG. 1 is a perspective view of a pedal actuated switch assembly according to the invention.
Figure 3:
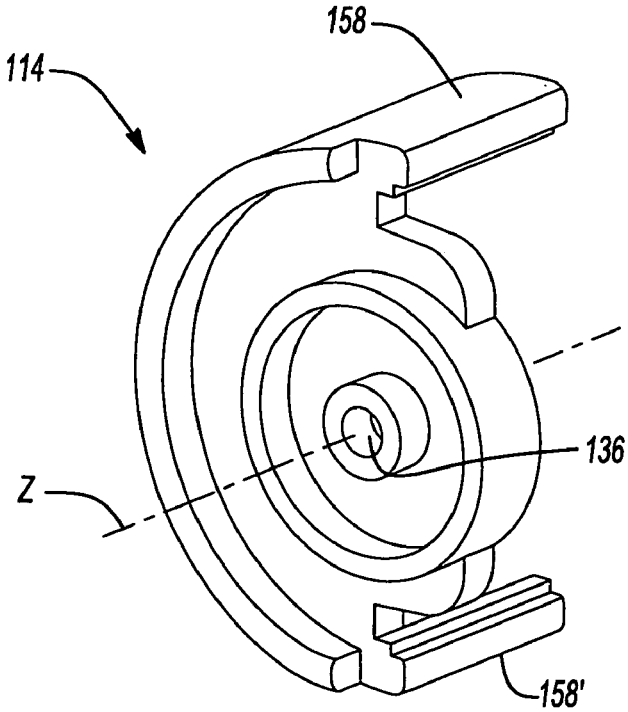
FIG. 3 is a rear perspective view of the rotational actuator of the pedal actuated switch assembly of FIG. 2A.
Figure 2A:
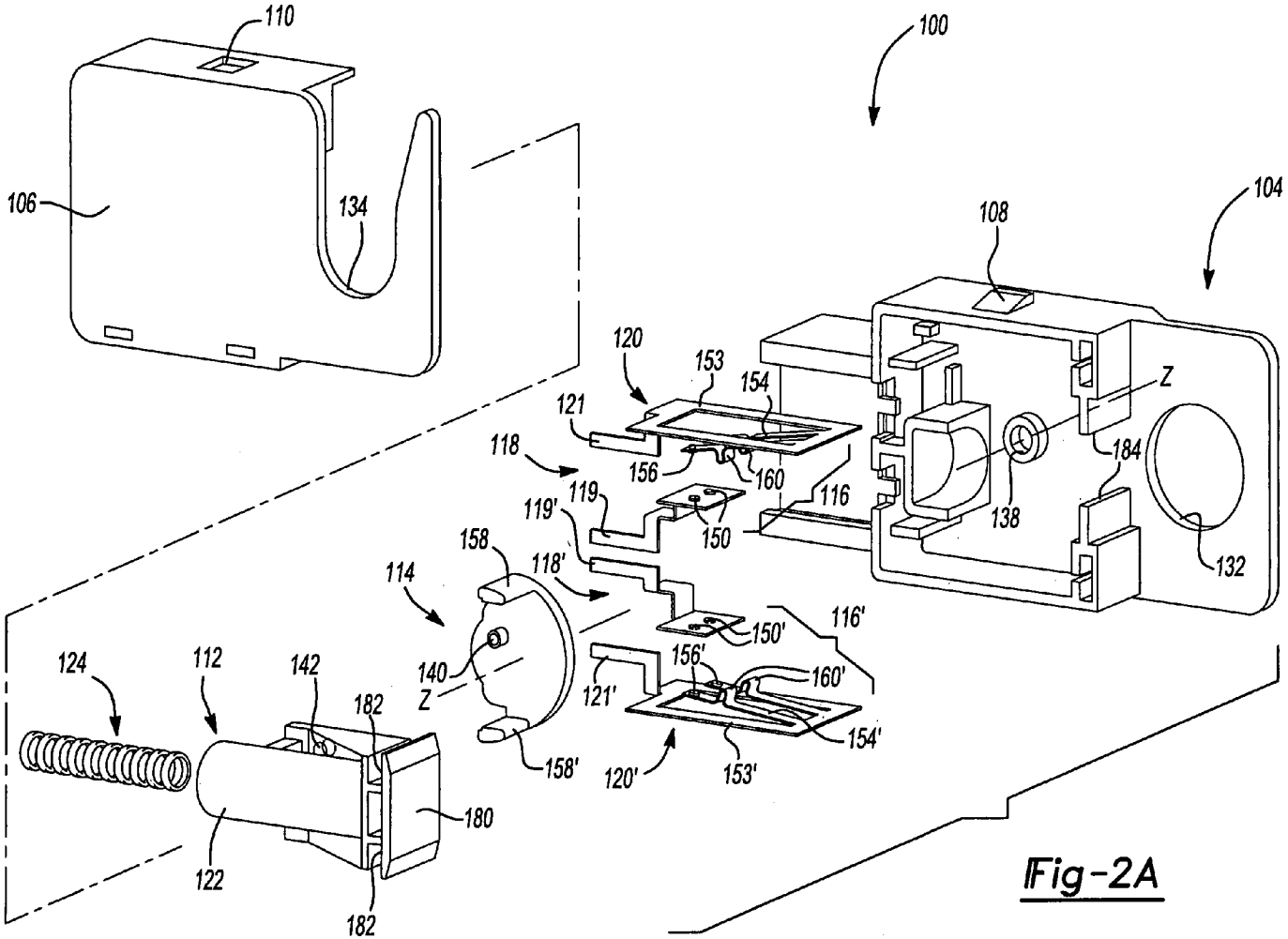
FIG. 2A is an exploded view of the pedal actuated switch assembly of FIG. 1.
Figure 2B:
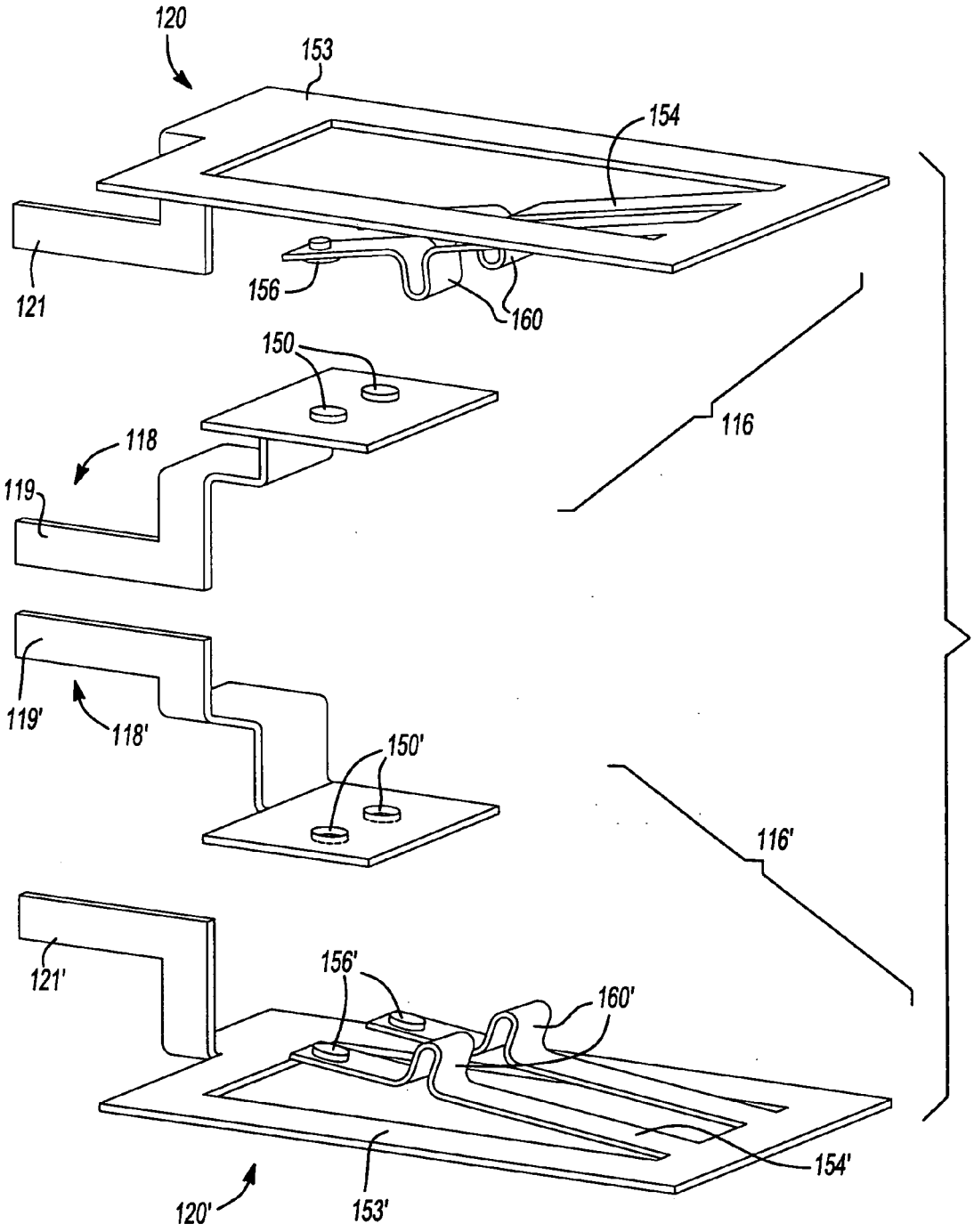
FIG. 2B is an enlarged view of first and second switches of the switch assembly of FIG. 2A.

The switch assembly 100 also includes a linear actuator, such as a plunger 112 which is best seen in FIG. 2A, a rotational actuator 114, and first and second electrical switches 116, 116', all of which can be supported on structural features of the base 104. The plunger 112 defines a tubular portion 122 that can receive a spring member 124, such as a coiled compression spring. The plunger 112 includes a mount portion 180 that defines two U-shaped slots 182. When the plunger 112 is mounted on the base 104, the slots 182 receive corresponding tabs 184 that are molded on the base 104. The plunger 112 is balanced between the biasing action of the spring member 124 and a biasing action from the push rod 50, such that first and second clearances 170, 172 are defined between each slot 182 and the corresponding tab 184. The relative width of the clearances 170, 172 depends on whether the pedal 60 is at rest, as shown in FIG. 4, or depressed, as shown in FIG. 5, as will be discussed below.

The rotational actuator 114 is supported on the base 104 for rotation about an axis "Z" (best seen in FIGS. 2A and 3) by a hub-to-hub connection, for example. The hub-to-hub connection comprises rotatably mating hubs 136, 138 on opposing faces of the rotational actuator 114 and the base 104. The plunger 112 is coupled to the rotational actuator 114 such that linear longitudinal travel of the plunger 112, caused by relative movement between the housing 102 and the push rod 50, results in rotation of the rotational actuator 114. In the illustrative embodiment of FIGS. 2A, 2B and 3, the plunger 112 and the rotational actuator 114 are coupled by a projection such as a post 140 rotatably mating with an aperture 142. The post 140 is parallel to, but offset from the axis Z.

Although the post 140 is shown extending from the rotational actuator 114, and the mating aperture 142 is shown on the plunger 112, as best seen in FIG. 2A, the post-aperture arrangement can be reversed. It will be appreciated that other known in the art coupling arrangements between the rotational actuator 114 and the base 104, and between the plunger 112 and the rotational actuator 114 can also be used. The rotational actuator 114 includes first and second cams 158, 158', arranged along a periphery of the rotational actuator 114 on opposite sides of the post 140 and at equal distance from the axis Z. In the embodiment illustrated in FIG. 3, the cams 158, 158' are positioned at the end of a circular arc of the rotational actuator 114. The circular arc has an arc length greater than $\pi$, such that the cams 158, 158', although equidistant from the axis Z, are not diametrically opposite relative to the axis Z. The post 140 is offset from the axis Z and is located at unequal distances between the cams 158, 158', thereby providing a displacement advantage as is discussed below.

Referring to FIG. 4, when the brake pedal 60 is not depressed and is at an at-rest orientation, the pedal pin 54 is biased against the opening 52 of the push rod 50, forming the crescent-shaped gap 58 on a first side of the pedal pin 54 away from the mount 180 of the plunger 112. The plunger 112 is biased by the spring member 124 and the spring action of the push rod 50 at a position in which the first clearance 170 is wider than the second clearance 172 between the slots 182 of the plunger and the tabs 184 of the base 104. Effectively, the plunger 112 is biased relative to the base 104 in the direction of an arrow "A" causing the rotational actuator 114 to rotate in the direction of a curved arrow "B" (clockwise, in the view of FIG. 4). In this position, the first electrical switch 116 is electrically disconnected ("open") and the second electrical switch 116' is electrically connected ("closed").

Referring to FIG. 5, when the brake pedal 60 is depressed in a direction defined by an arrow "F" such that the brake pedal 60 rotates in a direction defined by a curved arrow "G", the pedal pin 54 is biased in a direction opposite to an arrow "C", effectively moving the crescent-shaped gap 58 on a side of the pedal pin 54 nearer the mount 180 of the plunger 112. The plunger 112 is biased relative to the base 104 in the direction of the arrow C causing the rotational actuator 114 to rotate in the direction of a curved arrow "D" (counterclockwise, in the view of FIG. 5). In this position, the first electrical switch 116 is electrically connected ("closed") and the second electrical switch 116' is electrically disconnected ("open"). Therefore, the linear travel associated with width of the crescent-shaped gap 58 is sufficient to cause a change in the electrical connection status of the electrical switches 116, 116' that can be read by a control module of the vehicle, as known in the art. Accordingly, the switch assembly 100 is actuated upon an initial depression of the pedal 60 corresponding to the travel associated with the gap 58 and before continued depression of the pedal 60 actuates the braking action of the vehicle.

Referring to FIGS. 2A, 2B, 3 and 4, the first and second electrical switches 116, 116' open and close corresponding electrical circuits in the vehicle with pairs of outer terminal 119, 121 and 119', 121', and operate to transmit electrical signals to one or more control modules of the vehicle by electrically connecting or disconnecting those electrical circuits. The electrical switches 116, 116' can be mounted on the base 104 on opposite sides of the rotational actuator 114. Each of the electrical switches 116, 116' can include a static terminal 118, 118' and a spring terminal 120, 120', respectively. Each static terminal 118, 118', is fixedly supported in the base 104 of the housing 102 and is not intended to move. Each of the static terminals 118, 118' can include two contact pads 150, 150', respectively, for a total of four contact pads (two contact pads 150 and two contact pads 150'). Each spring terminal 120, 120' can include a pair of flexible arms 154, 154', respectively, for a total of four flexible arms. Each pair of arms 154, 154' is cantilevered from a frame 153, 153' which is common to the respective pair of arms 154, 154' and is supported on the base 104. Each individual arm 154, 154' is capable of independent motion. Each arm 154, 154' includes a contact pad 156, 156' opposite the contact pad 150, 150' of the corresponding static terminal 118, 118'. The contact pads 150, 150', 156, 156' are electrically conductive, such that when the contact pads 150, 150' of the corresponding static terminals 118, 118' are in physical contact with the contact pads 156, 156' of the corresponding spring terminals 120, 120', the corresponding electrical switches 116, 116' are electrically conductive ("closed").

Each arm 154, 154' of each spring terminal 120, 120' includes a cam follower 160, 160', which is configured to interact with the adjacent cam 158, 158' of the rotational actuator 114 when the rotational actuator 114 is rotated toward the cam follower 160, 160'. When the cam follower 160, 160' is not engaged with the cam 158, 158', the corresponding arm 154, 154' is biased to provide contact between the contact pads 150, 156 and 150', 156' of the corresponding static and spring terminals 118, 120, and 118', 120', thereby providing electrical conductivity to the corresponding electrical switch 116, 116'.

More specifically, referring to FIG. 4, rotation of the rotational actuator 114 in the direction of the arrow B causes the cam 158 to engage with the cam follower 160, such that each arm 154 of the spring terminal 120 is biased to deflect away from the static terminal 118, and electrical and physical contact between the contact pads 156 and 150 is lost. Concurrently, cam 158' and cam follower 160' are disengaged, the arms 154' of the spring terminal 120' are undeflected (unbiased), and contact pads 156' and 150' are in physical and electrical contact.

As described above and as best seen in FIG. 2B, each of the spring terminals 120, 120' is bifurcated, comprising a pair of flexible cantilevered arms 154, 154' respectively, although spring terminals 120, 120' with a single arm 154, 154' can also be used. The bifurcated spring terminals 120, 120' provide a parallel connection, which reduces electrical contact resistance, reduces heat generation, and distributes the electrical current between the pairs of electrical contact pads 150, 156 and 150', 156', thereby improving the reliability of the switch assembly. Additionally, each of the cantilevered arms 154, 154' can be designed with a low spring rate, such that a brushing action or a mechanical wipe effect is achieved at the mating electrical contact pads 150, 156 and 150', 156' when each arm 154, 154' establishes contact as it returns from a deflected to an undeflected position. Mechanical wipe can break through nonconductive films that may be present at the surface of the electrical contact pads 150, 156 and 150', 156'. Therefore, it will be appreciated that using such spring terminals 120, 120' enables the switch assembly 100 to operate well for both low current and high current applications. The resulting redundancy of electrical conductivity helps improve the reliability of the switch assembly 100 and prevent nonconductive debris from affecting the performance of the switch assembly 100.

Referring to FIG. 5, rotation of the rotational actuator 114 in the direction of the arrow D causes the cam 158' to engage with the cam follower 160', such that the arm 154' of the spring terminal 120' is deflected away from the static terminal 118', and electrical and physical contact between the contact pads 156' and 150' is lost. Concurrently, cam 158 and cam follower 160 are disengaged, the arm 154 of the spring terminal 120 is undeflected, and contact pads 156 and 150 are in physical and electrical contact.

The offset between the post 140 and the rotational actuator pivot axis Z can be selected to provide a desired displacement advantage ratio such that the linear movement of the plunger 112 relative to the base 104 produces an amplified movement at the cams 158, 158' of the rotational actuator 114. The displacement advantage ratio, defined herein as the ratio of the distance of the cam 158 from the axis Z to the distance of the post 140 from the axis Z, can be at least 3.5 to 1, and greater than 4.5 to 1, if desired. In an exemplary embodiment, a displacement advantage ratio of 5.2:1 converts a 0.6 mm relative movement (corresponding to the width of the gap 58) of the plunger 112 to a rotational movement of the cams 158, 158' about 3.12 mm in arc length, which is sufficient to open and close electrical contact at the pairs of contact pads 150, 156, and 150', 156' with good reliability for substantially all vehicle builds, given the tight tolerances that are generally used between the push rod 50 and the pedal pin 54.

Referring to FIGS. 1–5, it will be appreciated that the switch assembly 100 can be mounted on the left or right side of the brake pedal 60. Access to the electrical switches 116, 116' is conveniently provided from the rear of the switch assembly 100 through the pairs of outer terminals 119, 121, and 119', 121', when the switch assembly 100 is mounted in the vehicle. Therefore, only one switch assembly 100 is required for all mounting locations for different vehicle builds. In the embodiment illustrated in FIG. 2A, the outer terminals 119, 121, and 119', 121' are substantially horizontal.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A pedal-actuated switch assembly comprising:

a housing;

a linear actuator resiliently supported in the housing for a linear movement relative to the housing, the linear actuator movable responsive to a movement of a pedal between a rest position and a depressed position;

a rotational actuator rotatably supported in the housing and coupled with the linear actuator such that a linear movement of the linear actuator produces a corresponding rotational movement of the rotational actuator; and at least one electrical switch supported in the housing and operable to open or close in response to the rotational movement of the rotational actuator.

2. The switch assembly of claim 1, further comprising a plurality of electrical switches supported in the housing, wherein at least one of the plurality of electrical switches is closed only when the pedal is in the rest position, and at least another of the plurality of electrical switches is closed only when the pedal is in the depressed position.

3. The switch assembly of claim 2, wherein each of the electrical switches comprises:

a static terminal supported in the housing; and a spring terminal for electrical contact with the static terminal, the spring terminal supported in the housing and movable between unbiased and biased positions responsive to the rotational movement of the rotational actuator, wherein the switch is closed when the spring terminal is in the unbiased position and the switch is open when the spring terminal is in the biased position.

4. The switch assembly of claim 3, wherein each spring terminal comprises first and second cantilevered arms comprising first and second contact pads, wherein each of the first and second cantilevered arms is independently movable.

5. The switch assembly of claim 4, wherein each of the static terminals comprises first and second contact pads for electrical contact with the first and second contact pads of the first and second cantilevered arms.

6. The switch assembly of claim 3, wherein the rotational actuator comprises a plurality of cams and the spring terminals comprise a cam followers, wherein each cam is selectively engageable with a respective cam follower for deflecting the respective spring terminal.

7. The switch assembly of claim 2, wherein each of the electrical switches provides a bifurcated parallel electrical connection.

8. The switch assembly of claim 7, wherein the spring terminals are selectively biased by opposite movement of the rotational actuator in opposite rotational directions corresponding to the rest and depressed positions of the pedal.

9. The switch assembly of claim 2, further comprising a biasing member coupling the linear actuator and the housing.

10. The switch assembly of claim 9, wherein the linear actuator further comprises a hollow tubular portion and the biasing member is received within the tubular portion of the linear actuator.

11. The switch assembly of claim 1, wherein one of the rotational actuator and the linear actuator comprises a projection and the other of the rotational actuator and the linear actuator comprises an aperture, the projection being received in the aperture such that the projection is rotatable within the aperture.

12. The switch assembly of claim 1, wherein the rotational actuator is rotatably coupled to the housing with a hub-to-hub connection.

13. The switch assembly of claim 1, wherein the linear actuator and the rotational actuator are coupled such that a given linear movement of the linear actuator produces a corresponding rotational movement of the rotational actuator of at least about 3.5 times greater than the linear movement.

14. The switch assembly of claim 1, wherein the rotational actuator is rotatably coupled to the housing about a first axis and rotatably coupled to the linear actuator about a second axis.

15. A brake system for a vehicle, the brake system comprising:

a brake pedal movable between a rest position and a depressed position; and a switch assembly actuatable by the brake pedal, the switch assembly comprising:

a housing;

a linear actuator resiliently supported in the housing and coupled with the brake pedal for linear movement relative to the housing and responsive to the movement of the brake pedal between the rest position and the depressed position;

a rotational actuator rotatably supported in the housing and coupled with the linear actuator such that a linear movement of the linear actuator produces a rotational movement of the rotational actuator; and a plurality of electrical switches supported in the housing and controllable by the rotational movement of the rotational actuator for selectively opening and closing the electrical switches, wherein:

when the brake pedal is in the rest position, the rotational actuator causes at least one electrical switch to close and at least another electrical switch to open; and when the brake pedal is in the depressed position, the rotational actuator causes at least one electrical switch to open and at least another electrical switch to close.

16. The brake system of claim 15, wherein each of the plurality of electrical switches comprises a static terminal electrically connectable to a spring terminal.

17. The brake system of claim 16, wherein each of the static and spring terminals is bifurcated for providing a parallel electrical connection.

18. The brake system of claim 16, wherein the rotational actuator comprises a plurality of cams and the spring terminals comprise cam followers, the cams operable to engage and disengage the cam followers of the spring terminals for controlling the opening and closing of the electrical switches.

19. An automotive brake pedal actuated switch assembly comprising:

a housing;

an electrical switch supported in the housing;

a linear actuator resiliently supported in the housing and coupled with the brake pedal for a linear movement relative to the housing;

a rotational actuator supported in the housing and coupled with the linear actuator, the rotational actuator pivotable about a first axis relative to the housing and pivotable about a second axis relative to the linear actuator, the first axis being offset from the second axis such that a linear movement of the linear actuator causes a corresponding rotational movement of the rotational actuator for selectively closing and opening the electrical switch.

20. The automotive switch assembly of claim 19, wherein the rotational actuator comprises a cam and the electrical switch comprises a movable terminal, the cam engageable with the terminal for moving the terminal between an a open and a closed position.

* * * * *